US012274906B2

(12) United States Patent
Henseler

(10) Patent No.: US 12,274,906 B2
(45) Date of Patent: Apr. 15, 2025

(54) SPOTTING SYSTEM FOR WEIGHT LIFTING

(71) Applicant: PowerLifting Ultra Support Systems, LLC, Eugene, OR (US)

(72) Inventor: Jeff Henseler, Eugene, OR (US)

(73) Assignee: Powerlifting Ultra Support Systems, LLC, San Diego, CA (US)

( * ) Notice: Subject to any disclaimer, the term of this patent is extended or adjusted under 35 U.S.C. 154(b) by 256 days.

(21) Appl. No.: 18/134,748

(22) Filed: Apr. 14, 2023

(65) Prior Publication Data

US 2024/0139576 A1 May 2, 2024

Related U.S. Application Data

(60) Provisional application No. 63/420,444, filed on Oct. 28, 2022.

(51) Int. Cl.
*A63B 21/078* (2006.01)

(52) U.S. Cl.
CPC ..... *A63B 21/0783* (2015.10)

(58) Field of Classification Search
CPC ..... A63B 17/00; A63B 17/02; A63B 21/078; A63B 21/0783; A63B 21/28; A63B 21/4035; A63B 71/0054; A63B 2071/0072; A63B 2225/09; A63B 2225/093; A63B 2244/09
See application file for complete search history.

(56) References Cited

U.S. PATENT DOCUMENTS 4,253,662 A * 3/1981 Podolak ..... A63B 21/0783 482/104
4,257,590 A * 3/1981 Sullivan ..... A63B 21/06 482/133
4,286,782 A * 9/1981 Fuhrhop ..... A63B 23/00 482/99
4,324,398 A * 4/1982 Hole ..... A63B 21/078 482/104
4,471,956 A * 9/1984 Marlo ..... A63B 21/4029 482/106
4,564,194 A * 1/1986 Dawson ..... A63B 21/0626 482/102
4,709,919 A * 12/1987 Cano ..... A63B 21/06 482/99
4,709,922 A * 12/1987 Slade, Jr. ..... A63B 21/0783 482/104

(Continued)

FOREIGN PATENT DOCUMENTS

GB 2254566 A * 10/1992 ..... A63B 21/00181

*Primary Examiner* — Gary D Urbiel Goldner
(74) *Attorney, Agent, or Firm* — Procopio, Cory, Hargreaves & Savitch LLP

(57) ABSTRACT

A spotting system for weight lifting includes a pair of support arms, each of which is configured for operative engagement to a central frame portion of a conventional weight lifting rack. This engagement can be provided using connectors or mounting brackets operatively engaged between the central frame portion which overhangs an area being used by a person exercising with barbells. The connectors or mounting brackets may include bolts, nuts, U-bolts, flanges, and other individual and combinations of connectors which will securely hold each of the support arms to an appropriate position on the central frame portion of the rack.

13 Claims, 4 Drawing Sheets

(56) References Cited

U.S. PATENT DOCUMENTS 4,826,155 A * 5/1989 James ..... A63B 21/00181 482/43
4,949,959 A * 8/1990 Stevens ..... A63B 21/4029 482/104
4,955,604 A * 9/1990 Pogue ..... A63B 21/0783 482/99
4,973,050 A * 11/1990 Santoro ..... A63B 21/00181 482/99
4,998,721 A * 3/1991 Anders ..... A63B 21/0783 482/4
5,190,510 A * 3/1993 Goodger ..... A63B 21/4029 482/104
5,407,403 A * 4/1995 Coleman ..... A63B 21/078 482/104
5,823,921 A * 10/1998 Dawson ..... A63B 21/00181 482/93
5,989,164 A * 11/1999 Kullman ..... A63B 21/078 482/93
6,669,607 B2 * 12/2003 Slawinski ..... A63B 21/0783 482/4
6,893,381 B2 * 5/2005 Slawinski ..... A63B 21/0783 482/4
7,063,649 B2 * 6/2006 Szultka ..... A63B 21/072 482/99
7,163,488 B2 * 1/2007 Anders ..... A63B 21/0724 482/4
7,374,515 B2 * 5/2008 Slawinski ..... A63B 21/0783 482/106
7,819,785 B2 * 10/2010 Maiaro ..... A63B 21/0626 482/4
8,444,537 B1 * 5/2013 Santoro ..... A63B 21/00181 482/92
8,784,281 B2 * 7/2014 Johnson, III ..... A63B 21/0783 482/106
10,456,614 B1 * 10/2019 Dube ..... A63B 24/0062
11,260,261 B2 * 3/2022 Henniger ..... A63B 21/062
11,878,197 B2 * 1/2024 Henniger ..... A63B 21/4043
11,878,205 B2 * 1/2024 Campbell ..... A63B 21/156
11,938,366 B2 * 3/2024 Yang ..... A63B 21/0724
12,179,054 B2 * 12/2024 Breaux ..... A63B 71/0619
2007/0179030 A1 * 8/2007 Slawinski ..... A63B 21/0724 482/99
2012/0058859 A1 * 3/2012 Elsom-Cook .... A63B 21/00181 482/4
2012/0244999 A1 * 9/2012 Tauriainen ..... A63B 21/078 482/104
2013/0190143 A1 * 7/2013 Greenhill ..... A63B 21/00181 482/104
2018/0200562 A1 * 7/2018 Nesbit ..... A63B 21/0783
2020/0376321 A1 * 12/2020 Davis ..... A63B 24/0062
2022/0193483 A1 * 6/2022 Campbell ..... A63B 21/062
2024/0366991 A1 * 11/2024 Henseler ..... A63B 21/0632

* cited by examiner

SPOTTING SYSTEM FOR WEIGHT LIFTING

BACKGROUND OF THE INVENTION

1. Field of the Invention

The invention herein disclosed relates generally to weight lifting. More particularly, it relates to a spotting system configured for engagement to power lifting rack stations.

2. Prior Art

BACKGROUND OF THE INVENTION

Weightlifting conventionally refers to activities wherein people exercising lift weights. Such weightlifting often is accomplished through the lifting of dumbbells or barbells.

For both sport and exercise, people lift various kinds of weights for a variety of different reasons. Such for example may include competition to determine which competitor can lift the most weight for the promotion of health and fitness. For non-competition, people will lift weights to develop physical strength and to enhance posture as well as bone density. Power lifting is a form of weight lifting which is a strength sport that consists of three attempts at maximal weight on three types of lifts. Such includes squatting, bench pressing and the deadlift.

As with any sport, athletes will endeavor between competitions to train using barbells and free weights as well as weight and exercise machines. Conventionally, rack stations are widely employed by people who use barbells during exercise and practice sessions with weights. Such rack stations conventionally will include a frame which will have two side sections and a central frame section which overhangs the area where a user will lift weights thereunder. For example, and in no way limiting, a bench press will include a bench positioned between the sidewalls of the frame forming the rack and underneath the central frame section. The user laying upon the bench will lift a barbell over their upper body multiple times.

A second person will normally act as a spotter and stand adjacent the person lifting the barbell. They must be ready to help lift the barbell along with the person using it, in case the lifting person cannot continue, or in many cases, to aid the person lifting the barbell during exercise.

The person acting as a spotter in most cases must have sufficient strength to lift the barbell from the person lifting should the person lifting not be able to continue to lift the barbell. In many cases this limits the available persons to act as a spotter to those with strength to lift the barbell themselves. Further, in most instances, the person lifting weights is limited to the accompanying of a spotter during exercises where they are lying down on a bench since it would be physically awkward if not impossible to aid a standing weightlifter during overhead lifts of a barbell.

With respect to the above, before explaining at least one preferred embodiment of the spotting system for weight and power lifting herein, it is to be understood that the disclosure is not limited in its application to the details of employment and to the arrangement of the components or the steps set forth in the following description or illustrated in the drawings. The various components and construction of the disclosed rack-engageable system for spotting of weight and power lifting and the methods and steps of employment thereof are capable of other embodiments and of being practiced and carried out in various ways. All such variations will be obvious to those skilled in the art once the information herein is reviewed and, thus, are considered within the scope of this disclosure and which are considered within the scope of this application.

Also, it is to be understood that the phraseology and terminology employed herein are for the purpose of description and should not be regarded as limiting. As such, those skilled in the art will appreciate that the conception upon which this disclosure is based may readily be utilized as a basis for other rack-engageable weight spotting systems. It is important, therefore, that the embodiments, objects, and claims herein, be regarded as including such equivalent construction, operation and methodology, insofar as they do not depart from the spirit and scope of the present disclosure.

SUMMARY OF THE INVENTION

The system herein provides for the spotting of weight lifters during many exercises where they are lifting weights engaged to a barbell. The system herein features a pair of support arms, each of which is configured for operative engagement to a central frame portion of a conventional weight lifting rack. This engagement, for example, can be provided using connectors or mounting brackets operatively engaged between the central frame section which overhangs the area being used by a person exercising with barbells. Such brackets may include bolts, nuts, U-bolts, flanges, and other individual and combinations of connectors which will securely hold each of the support arms to the appropriate position on the central frame portion of the rack.

The person exercising under the central frame portion may be for example using barbells while positioned on a bench lying down. Alternatively, they may be holding a barbell while performing squats, dead lifts, curls, or a military press or another exercise where the holding of a barbell with weights thereon is required.

Each support arm includes a member pathway through which respective flexible members such as cables or belts are operatively engaged. While flexible belts are preferred herein for smoothness of operation, flexible members can also include cables, ropes, or other flexible members as would occur to those skilled in the art which may be operatively engaged and slide along each member pathway.

The member pathway includes a first opening to an axial passage of each support arm and a second opening communicating with the axial passage at the opposite end from the first opening. Positioned at the first end of each support arm is a first roller or pulley. A second roller or pulley is located at the second end of each support arm. A flexible member is operatively positioned on each of the support arms whereby it will communicate along the member pathway and over the first roller, through their respective axial pathway, and over the second roller at the second end thereof.

A first end of each flexible member, is configured for a removable engagement to a barbell. Such a removable engagement can include a barbell connector formed of metal or plastic or in the current preferred mode of the system herein, the barbell connector is formed by the flexible member itself, wrapping around the exterior of the barbell.

A second end of each flexible member, is either engaged to, or configured for removable engagement to, a spotter bar. The spotter bar is an elongated rigid member, such as one formed of metal, which a spotter can grip with each of two hands. During use of the system, the spotter bar is held in an elevated position by the engagement thereof to each of the flexible members, at a position between the central frame section of the rack and the support surface on which the spotter will stand during spotting.

Concurrently, during use of the system, the first end of each of the flexible members will extend from the first end of each of the support arms to a respective engagement thereof, on the barbell being used by a person exercising. As the person lifting the barbell elevates it upward toward the central frame section of the rack, the spotter will preferably push or pull the spotter bar in a manner which maintains the flexible members extending between the first end of each support arm and the barbell taught. In this fashion, should the person lifting the barbell need help to continue, the spotter can push or pull on the spotter bar to communicate the force of such to the barbell and thereby aid the person lifting the barbell.

The system as such allows a spotter using the spotter bar and positioned adjacent to the person employing the barbell, to assist only when requested or needed. Because of the mechanical advantage provided by the communication of each flexible member at ninety degree angles over the first roller and the second roller, during use, the pool of spotters may be increased to persons who might not be considered strong enough to help lift. Further, in other embodiments of the device and system, secondary pulleys may be included along the member pathways to increase the mechanical advantage of the system if needed.

The system can also include a centrifugal safety in the form of rollers or engagements thereto which will stop or provide braking to the flexible members. The centrifugal safety can be set to actuate when the flexible member exceeds a preset speed limit which is determined to indicate that the barbell is moving too fast in the direction of the person lifting it.

Such may involve the use of tracks or the like formed on the flexible members which engage upon ridges formed on rollers which are configured to brake or stop once a predetermined speed is reached. Other modes for braking or stopping the flexible members may be employed as would occur to those skilled in the art such as a compressed engagement of each flexible member between the first roller and a spring loaded compressive roller which would provide the grip on the flexible member to allow it to be stopped or braked.

The two flexible members may be provided as single-piece components or in segments which may be operatively engaged. In either manner the overall length of each of the flexible members will be such that the first ends will removably engage to a barbell being used and the second ends thereof are engaged to the spotter bar at the appropriate height above the floor or support surface on which the spotter is positioned.

With respect to the disclosed rack-engageable spotting system for weight and power lifting disclosed herein, before explaining at least one preferred embodiment, it is to be understood that the disclosed aspect is not limited in its application to the details of operation nor the arrangement of the components or the steps set forth in the following description or illustrations in the drawings. The various structural configurations and implementation of the rack-engageable spotting system herein are capable of other embodiments and of being practiced and carried out in various ways which will be obvious to those skilled in the art once they review this disclosure. Also, it is to be understood that the phraseology and terminology employed herein are for the purpose of description of the rack-engageable spotting system and should not be regarded as limiting.

An aspect of the invention involves a spotting system configured for engagement to a weight rack for spotting lifting of weights engaged to a barbell in a weight lifting area comprising one or more supports configured for operative engagement to the weight rack so that the one or more supports overhang the weight lifting area, the one or more supports including one or more flexible member pathways; one or more flexible members operatively engaged within the one or more flexible member pathways, the one or more flexible members including a first end configured to be coupled to the barbell and an opposite second end configured to be coupled to a spotter member, wherein the one or more supports are configured to provide a mechanical advantage by the communication of one or more flexible members thereon to assist in spotting lifting of weights engaged to the barbell.

One or more implementations of the above aspect of the invention include one or more of the following: the one or more supports include a first end and an opposite second end, the one or more flexible member pathways include an axial passage, a first opening to the axial passage at the first end, and a second opening to the axial passage at the second end communicating with the first opening via the axial passage; a first roller at the first end of the one or more supports, a second roller at the second end of the one or more supports, the one or more flexible members is operatively positioned on the one or more of the support arms whereby it will communicate along the one or more flexible member pathways and over the first roller, through the axial pathway, and over the second roller at the second end; the one or more flexible members are disposed at ninety degree angles over the first roller and the second roller; one or more connectors operatively engaging the one or more supports to the weight rack; the one or more flexible members are one of a single-piece member and a multiple-piece member; and/or the spotter member is a spotter bar configured to be gripped by one or both of user's hands.

Another aspect of the invention involves a method of using a spotting system comprising a spotting system configured for engagement to a weight rack for spotting lifting of weights engaged to a barbell in a weight lifting area comprising one or more supports configured for operative engagement to the weight rack so that the one or more supports overhang the weight lifting area, the one or more supports including one or more flexible member pathways; one or more flexible members operatively engaged within the one or more flexible member pathways, the one or more flexible members including a first end configured to be coupled to the barbell and an opposite second end configured to be coupled to a spotter member, wherein the one or more supports are configured to provide a mechanical advantage by the communication of one or more flexible members thereon to assist in spotting lifting of weights engaged to the barbell, the method comprising holding the spotter member in an elevated position by the one or more flexible members; as a weight lifter lifts the barbell, if the weight lifter needs assistance lifting the barbell, moving the spotter member downward so that the one or more flexible members pull up on the barbell so as to assist the weight lifter in the lifting of the barbell.

One or more implementations of the immediately above aspect of the invention include one or more of the following: prior to the weight lifter lifting the barbell, moving the spotter member downward so as to maintain the one or more flexible members extending between the one or more supports and the barbell taught; the weight rack includes a central frame section, and holding the spotter member includes holding the spotter member in an elevated position by the one or more flexible members at a position between the central frame section of the rack and a support surface on which a spotter will stand during spotting; the one or more supports include a first end and an opposite second end, the one or more flexible member pathways include an axial passage, a first opening to the axial passage at the first end, and a second opening to the axial passage at the second end communicating with the first opening via the axial passage, and moving the spotter member downward includes moving the spotter member downward so that the one or more flexible members communicate along the axial passage, the first opening, and the second opening, pulling up on the barbell so as to assist the weight lifter in the lifting of the barbell; the spotting system includes a first roller at the first end of the one or more supports, a second roller at the second end of the one or more supports, the one or more flexible members is operatively positioned on the one or more of the support arms, and moving the spotter member downward includes moving the spotter member downward so that the one or more flexible members communicate along the one or more flexible member pathways and over the first roller, through the axial pathway, and over the second roller at the second end; the one or more flexible members are disposed at ninety degree angles over the first roller and the second roller, and moving the spotter member downward includes moving the spotter member downward so that the one or more flexible members communicate along the one or more flexible member pathways and over the first roller and the second roller at ninety degree angles over the first roller and the second roller; and/or the spotter member is a spotter bar, and moving the spotter member downward includes gripping the spotter bar by one or both of a user's hands.

As such, those skilled in the art will appreciate that the conception upon which this disclosure is based may readily be utilized as a basis for designing of rack-engageable spotting systems, methods, and device configurations for carrying out the several purposes of the disclosed device and system herein. Therefore, the objects and claims herein should be regarded as including any and all such equivalent construction, components, steps, and methodology insofar as they do not depart from the spirit and scope of the present invention.

An aspect of this disclosure involves a spotting system which provides the mechanical advantage to allow for an increase in the number of persons able to spot for weight lifters.

Another aspect of this disclosure involves such a spotting system which is easily engageable to a wide variety of conventional weight lifting racks.

These, together with other aspects and advantages which will become subsequently apparent, reside in the details of the construction and configurations of the rack-engageable spotting system herein as more fully hereinafter described and claimed, reference being had to the accompanying drawings forming a part thereof, wherein like numerals refer to like parts throughout.

Also, further aspects of this rack-engageable spotting system disclosure will be ascertained by those skilled in the art as brought out in the following part of the specification wherein the detailed description is for the purpose of fully disclosing the invention without placing limitations thereon.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Finally, by the term "substantially" is meant plus or minus five percent.

Also, in the descriptions herein, it is to be understood that terms such as front, back, inside, outside, top, bottom and the like, are words of convenience only and are not to be construed as limiting terms. Terminology used herein is not meant to be limiting insofar as devices described herein, or portions thereof, and they may be attached or utilized in other orientations. The various aspects will be described in more detail with reference to the drawings.

BRIEF DESCRIPTION OF DRAWING FIGURES

The accompanying drawings, which are incorporated herein and form a part of the specification, illustrate some, but not the only or exclusive examples of embodiments and/or features of the disclosed rack-engageable spotting system herein. It is intended that the embodiments and figures disclosed herein are to be considered illustrative of the invention herein, rather than limiting in any fashion.

Figure 4:
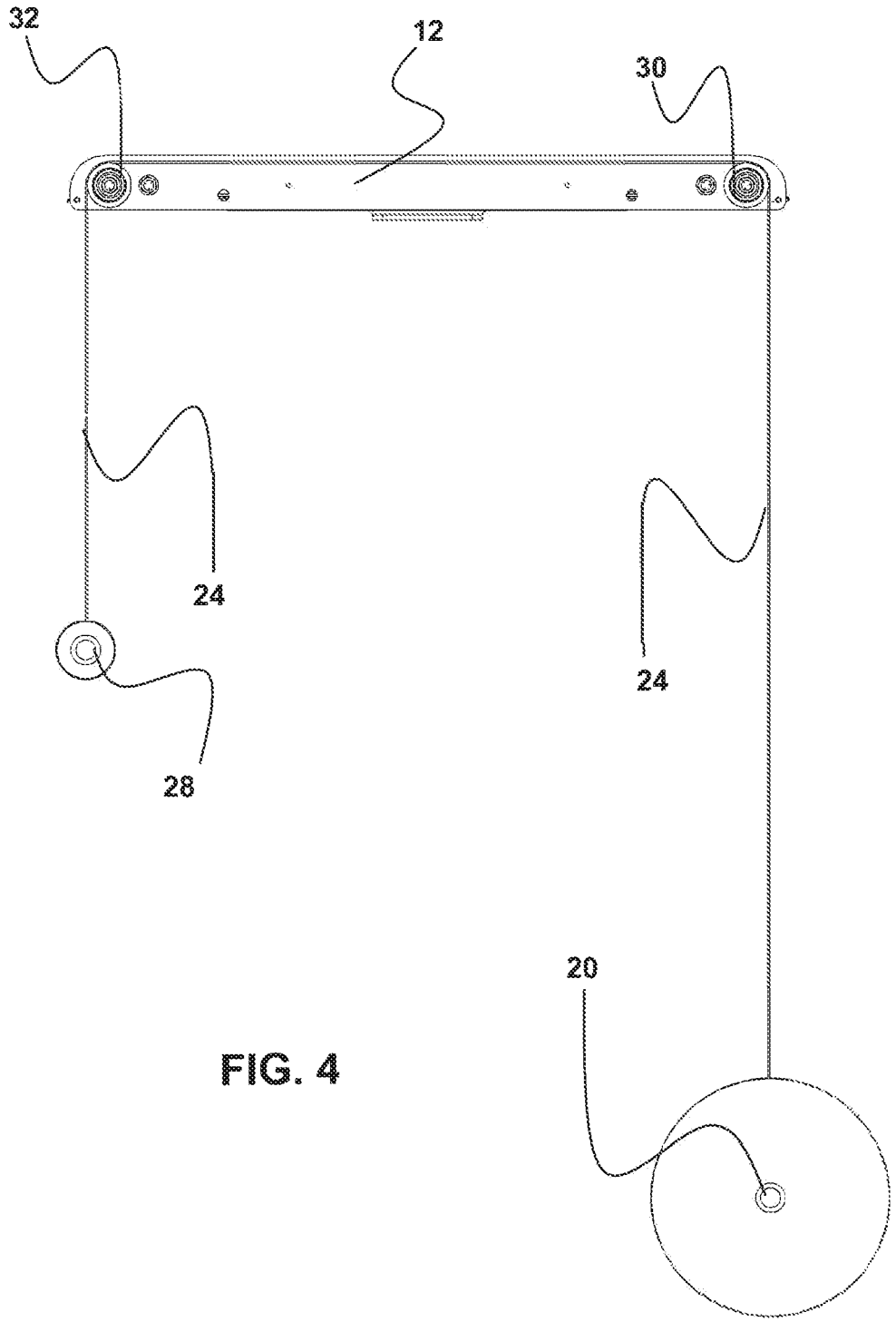

FIG. 4 a side view of a support member with a side portion removed to better show the communication of the flexible member along the pathway through the support member to respective engagements to a barbell and a spotter bar.

DETAILED DESCRIPTION OF THE PREFERRED EMBODIMENTS OF THE INVENTION

Figure 1:
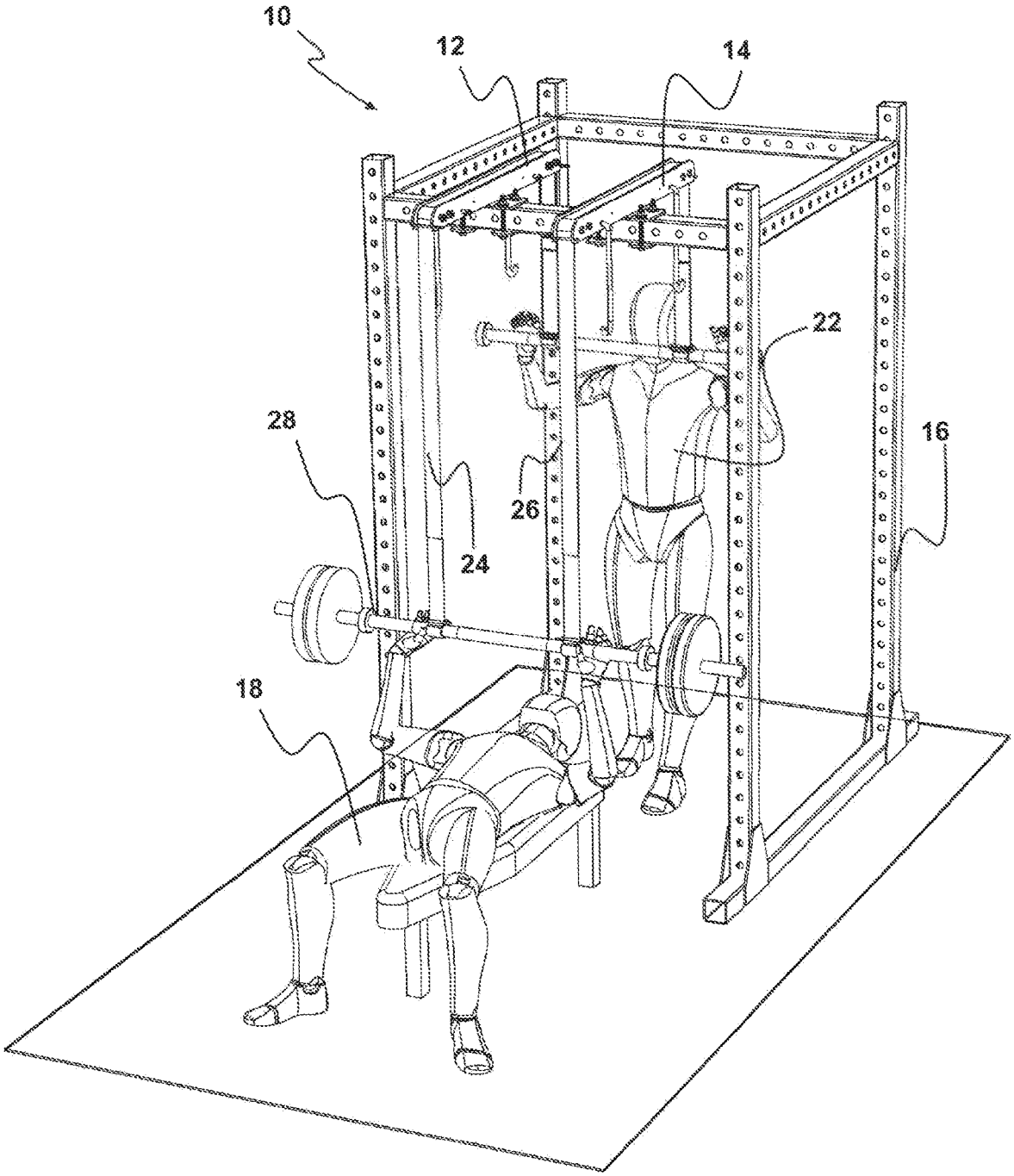
FIG. 1 shows a perspective view of the weight rack-engageable spotting system herein showing the two support arms operatively engaged in a central portion of a conventional barbell rack.

Referring now to the rack-engageable spotting system 10 herein shown in FIGS. 1-4, there is seen in FIG. 1, a perspective view of the weight rack-engageable spotting system 10 herein showing a first support arm 12 and a second support arm 14 both of which are configured for engagement to a central portion of an overhanging member of a conventional weight machine rack 16. The system 10 herein may also be provided with a support rack similar to a weight machine rack 16 where users use benches and free weights without such a rack 16.

As shown in FIG. 1, operation of the system 10 enables the user 18 when lifting a barbell 20 to be aided by a spotter 22 during exercise. A first flexible member 24 and a second flexible member 26 are both engaged at respective first ends, to the barbell 20. Such is preferably a removable engagement as noted below. The respective second ends of each of the first flexible member 24 and second flexible member 26, are engaged to a spotter bar 28. During lifting of the barbell 20 by the user 18, the spotter 22 can aid the user by imparting downward force upon the spotter bar 28.

Figure 2:
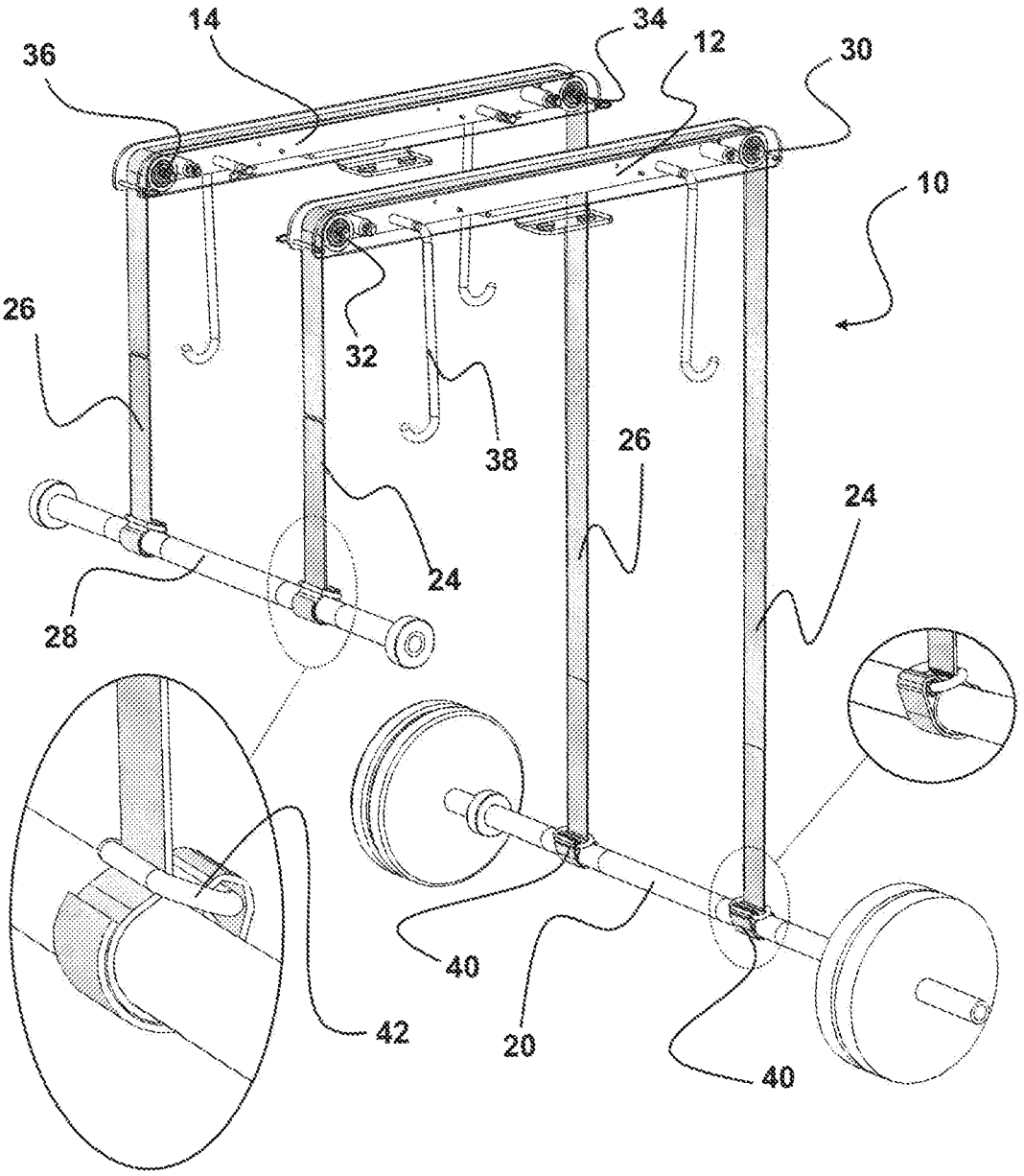
FIG. 2 shows a perspective view of the components of the rack-engageable spotting system and shows enlarged views of one mode of connections of the flexible members to both the barbell and a spotter bar and also depicts the first member pathway and second member pathway for the flexible members.
Figure 3:
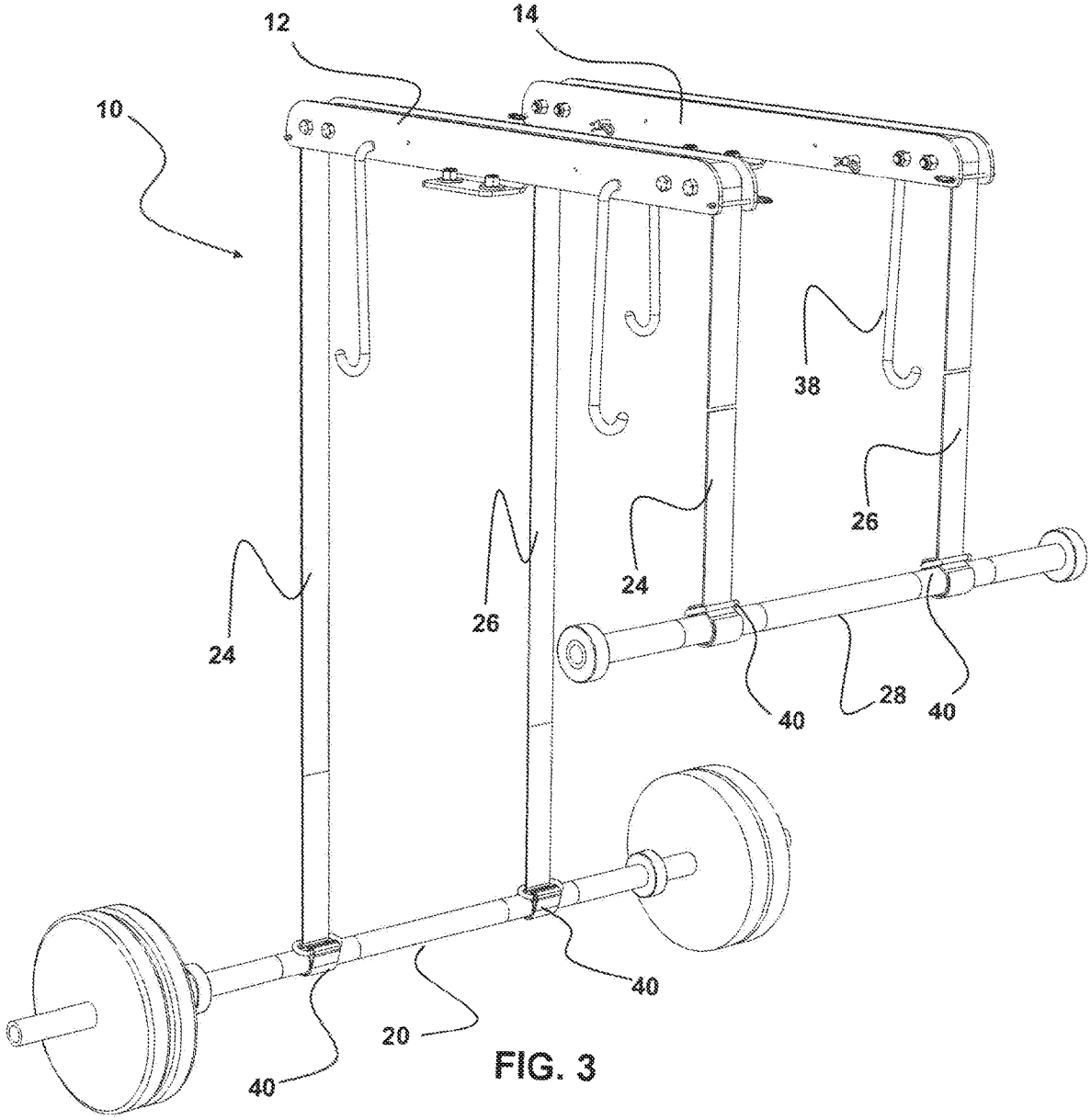
FIG. 3 depicts a view of the rack-engageable spotter system from an opposite perspective view of that of FIG. 2.

The system 10 is shown in FIGS. 2 and 3 in perspective views without the weight machine 16 to which it engages provides a view of the system operation. As shown, the first flexible member 24 engages at the first end with the barbell 20 and at the second end thereof with the spotter bar 28. This first flexible member 24 follows a first pathway over the first support member 12. This first pathway includes a first roller or pulley 30 over which the first flexible member makes a ninety degree turn and continues to a second ninety-degree turn around the second pulley 32. In another embodiment, a third roller or pulley is mounted on the spotter bar 28 on both sides with the ends of the first flexible member 24 and second flexible member 26 attached to the first support arm 12 and the second support arm 14 to create a 2:1 mechanical advantage.

The second flexible member 26 follows a second pathway upon the second support arm 14. From the barbell 20 the second flexible member 26 runs at a ninety degree angle over a third pulley 34 to a second ninety-degree path over a fourth pulley 36 to a connection at the second end thereof which is engaged with the spotter bar 28.

As can be discerned, downward pressure exerted on the spotter bar 28 is communicated by the first flexible member 24 and second flexible member 26 as upward force to the barbell 20. In this fashion, the spotter 22 can exert more or less downward pressure as necessary to aid the lifting of the barbell 20 by a user.

Also shown in FIGS. 1 and 2 are hooks 38 which are employable to hold the spotter bar 28 when not in use.

Barbell connectors 40 are positioned at the first end of each of the first flexible member 24 and second flexible member 26 to engage them with the barbell. Preferably the barbell connectors 40 are removably engageable to the barbell 20 to allow use thereof without the system 10. Currently clips 42 allow for a cinched or compressive engagement for the barbell connectors 40 however other connectors as would occur to those skilled in the art are employable. Similar clips 42 provide for a compressive connection to form the spotter bar connectors 44 shown; however, other spotter bar connectors 44 are anticipated as employable.

Shown in FIG. 4, is a side view of the first support member 12 showing the flexible member pathway followed by the first flexible member 24. As shown, the first flexible member 24 is engaged at a first end to the barbell 20 and extends therefrom to the ninety-degree passage over the first pulley 30. The flexible member continues to the ninety-degree path over the second pulley 32 to the engagement to the spotter bar 28. A substantially similar path is followed by the second flexible member 26 over the second support arm 14 to the engagement thereof at the second end thereof with the spotter bar 28.

While all of the fundamental characteristics and features of the disclosed weight rack-engageable spotting system herein have been shown and described herein, with reference to particular embodiments thereof, a latitude of modification, various changes and substitutions are intended in the foregoing disclosure and it will be apparent that in some instances, some features of the frame system may be employed without a corresponding use of other features thereof, without departing from the scope of the invention as set forth. It should also be understood that various substitutions, modifications, and variations may be made by those skilled in the art upon their review of this specification, without departing from the spirit or scope of the device and system herein. Consequently, all such modifications and variations and substitutions are included within the scope of the invention as defined by the following claims.

What is claimed is:

1. A spotting system configured for engagement to a weight rack for spotting lifting of weights engaged to a barbell in a weight lifting area, the spotting system being non-electrical, non-motorized, and comprising:

one or more supports configured for operative engagement to the weight rack so that the one or more supports overhang the weight lifting area, the one or more supports respectively including one or more flexible member pathways;

one or more flexible members operatively and respectively engaged within the one or more flexible member pathways, the one or more flexible members each including a first end configured to be coupled to the barbell and an opposite second end configured to be coupled to a spotter member, wherein the one or more supports are configured to provide a mechanical advantage by a corresponding communication of one or more flexible members thereon to assist in spotting of the lifting of weights engaged to the barbell;

wherein the spotter member is a spotter bar configured to be gripped by one or both hands of a user and oriented substantially horizontally in a resting position thereof; and wherein the barbell is configured to be freely moveable in three dimensions relative to the weight rack during the lifting of the weights in the weight lifting area.

2. The spotting system of claim 1, wherein each of the one or more supports includes a first end and an opposite second end, each of the one or more flexible member pathways includes an axial passage, a first opening to the axial passage at the first end, and a second opening to the axial passage at the second end communicating with the first opening via the axial passage.

3. The spotting system of claim 2, further including a first roller at the first end of each of the one or more supports, a second roller at the second end of each of the one or more supports, the one or more flexible members is operatively and respectively positioned on the one or more supports whereby the one or more flexible members will respectively communicate along the one or more flexible member pathways and over the first roller, through the axial pathway, and over the second roller at the second end.

4. The spotting system of claim 3, wherein the one or more flexible members are respectively disposed at ninety degree angles over each of the first roller and the second roller.

5. The spotting system of claim 1, further including one or more connectors operatively and respectively engaging the one or more supports to the weight rack.

6. The spotting system of claim 1, wherein the one or more flexible members are one of a single-piece member and a multiple-piece member.

7. A method of using the spotting system of claim 1, the method comprising:

the one or more flexible members holding the spotter member in an elevated position;

as a weight lifter lifts the barbell, if the weight lifter needs assistance lifting the barbell, moving the spotter member downward so that the one or more flexible members pull up on the barbell so as to assist the weight lifter in the lifting of the barbell.

8. The method of claim 7, prior to the weight lifter lifting the barbell, moving the spotter member downward so as to maintain the one or more flexible members extending taught between the one or more supports and the barbell.

9. The method of claim 7, wherein the weight rack includes a central frame section, and wherein the elevated position is a position between the central frame section of the rack and a support surface on which the user will stand during the spotting of the lifting of the weights engaged to the barbell.

10. The method of claim 7, wherein each of the one or more supports includes a first end and an opposite second end, each of the one or more flexible member pathways includes an axial passage, a first opening to the axial passage at the first end, and a second opening to the axial passage at the second end communicating with the first opening via the axial passage, and moving the spotter member downward further includes moving the spotter member downward so that the one or more flexible members respectively communicate along the axial passage, the first opening, and the second opening, pulling up on the barbell so as to assist the weight lifter in the lifting of the barbell.

11. The method of claim 10, wherein the spotting system includes a first roller at the first end of the one or more supports, a second roller at the second end of each of the one or more supports, the one or more flexible members is operatively and respectively positioned on the one or more supports, and moving the spotter member downward further includes moving the spotter member downward so that the one or more flexible members respectively communicate along the one or more flexible member pathways and over the first roller, through the axial pathway, and over the second roller at the second end.

12. The method of claim 11, wherein the one or more flexible members are respectively disposed at ninety degree angles over each of the first roller and the second roller, and moving the spotter member downward further includes moving the spotter member downward so that the one or more flexible members respectively communicate along the one or more flexible member pathways and over the first roller and the second roller at ninety degree angles over each of the first roller and the second roller.

13. The method of claim 12, wherein moving the spotter member downward further includes gripping the spotter bar by the one or both hands of the user.

* * * * *